US007748479B2

(12) United States Patent
Barbera

(10) Patent No.: US 7,748,479 B2
(45) Date of Patent: Jul. 6, 2010

(54) BOX GUSSETED EARTH AUGER

(76) Inventor: James S. Barbera, 11214 Hickory Hollow, Bolivar, OH (US) 44612

( * ) Notice: Subject to any disclaimer, the term of this patent is extended or adjusted under 35 U.S.C. 154(b) by 73 days.

(21) Appl. No.: 12/128,760

(22) Filed: May 29, 2008

(65) Prior Publication Data

US 2009/0294181 A1 Dec. 3, 2009

(51) Int. Cl.
*E21B 17/22* (2006.01)

(52) U.S. Cl. ..... 175/323; 175/394

(58) Field of Classification Search ..... 175/323, 175/394; 405/241; 198/666
See application file for complete search history.

(56) References Cited

U.S. PATENT DOCUMENTS 3,300,988 A * 1/1967 Phares et al. ..... 405/239
4,819,744 A * 4/1989 Caswell ..... 175/18
5,452,967 A * 9/1995 Fuller ..... 405/184
5,782,310 A * 7/1998 Lange ..... 175/323
6,467,558 B2 * 10/2002 Miyamoto et al. ..... 175/71
7,591,329 B2 * 9/2009 Perpezat et al. ..... 175/384
2006/0060386 A1 * 3/2006 Reich ..... 175/323
2007/0068706 A1 * 3/2007 Harleman ..... 175/323
2008/0179101 A1 * 7/2008 Mash ..... 175/325.1

* cited by examiner

*Primary Examiner*—Shane Bomar
(74) *Attorney, Agent, or Firm*—Sand & Sebolt

(57) ABSTRACT

A brace or gusset is added to the first and last flight blade of an auger length for stability and reinforcement. The braces are generally box shaped with the flight blade as the box bottom. The brace walls are welded together along with a top panel. The brace is adjacent the auger shaft on one end and complementary shaped on one side to conform to the shape of the flight helix. A deflector is added to the last flight blade to distribute dirt and debris away from the first flight blade on the subsequent auger length. The auger length is reinforced against the twisting torque and compressive forces that occur at the first and last flight blade.

14 Claims, 8 Drawing Sheets

BOX GUSSETED EARTH AUGER

BACKGROUND OF THE INVENTION

1. Technical Field

This invention relates to earth boring equipment. More particularly, this invention relates to an auger bit extension length. Specifically, this invention relates to a novel earthen auger length having a reinforced boring flight at the front end, as well as a reinforced boring flight and soil deflector at the back end.

2. Background Information

Earthen auger bits are used to bore holes in soil for the emplacement of fence posts, telephone poles, and the like. An earthen auger bit is used with a power mechanism for overall lateral movement to drive the bit into the soil. The power mechanism is also used for axial movement in rotating the bit. From forward movement, as well as axial spinning of the auger blade, the bit penetrates deeper into the soil and rock.

Resembling a corkscrew, the bit has six parts: screw, spurs, cutting edges, flight, shaft, and tang. The screw, also called a pilot point, is long and smaller than the flight in diameter; it centers the bit and draws it into the earth. At the working end of the flight there may be sharp points called spurs, which score a circle equal in diameter to the hole, and radial cutting edges that cut material within the scored circle. The flight is helical and the rotation and outward spiraling of the flight results in soil moving back out of the hole along the spiral. The shaft extends along the entire inner diameter of the bit, beginning with the tang and ending with the tip of the screw. The tang can be any shape, but usually square or hexagonal, and fits in either the chuck on the power mechanism, or another auger length used for extending the length of the bore hole. Additional auger lengths are added as the cutting head of the auger penetrates deeper into the earth. The size of the auger length depends on the pitch, thickness, and length of the desired hole.

A general auger length can be separated in two parts: a bit, comprising the screw, spur, cutting edges and tang, can be separate from the lengths, comprising the flight, shaft and tang. This enables each length to be interchangeable. The first end of each length comprises a tang receiving hole and the second end of each length comprises a tang. In this method, lengths can be "stacked" on each other as more drilling depth is required, as the first length receives the tang into the tang receiving hole.

BRIEF SUMMARY OF THE INVENTION

In general, the earth auger of the present invention is defined as comprising a pilot point and cutting edges on an auger bit, and a flight, shaft, tang, reinforcement braces and a deflector on an auger length. As the auger penetrates the earth, the flight rotates axially driving the auger deeper and pulling the soil out of the bore hole through the helical rotation of the flight. The leading flight blade undergoes tremendous torque and compressive forces from penetrating the earth and breaking up the soil or rock.

The present invention reinforces the lead flight blade by applying a flight brace proximate to the front end of the auger length. This brace adds to the strength of the lead flight and reduces stress and fatigue on the auger length. A flight brace is also added to the last flight blade, thus strengthening the connection area where two lengths are combined and require the most torque reinforcement due to a break in the overall shaft of the auger. This also helps to stabilize the shafts when stacked together and held by the tang and tang receiving hole.

A deflection mechanism is also applied to the last flight and proximate the back end of the auger length. The deflector is used to move rock and soil outwardly from the shaft such that it is collected by the next flight blade and prevents soil from contacting the front flight brace of the subsequent auger length. This adds to the overall stability and reinforcement of the first auger flight blade.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
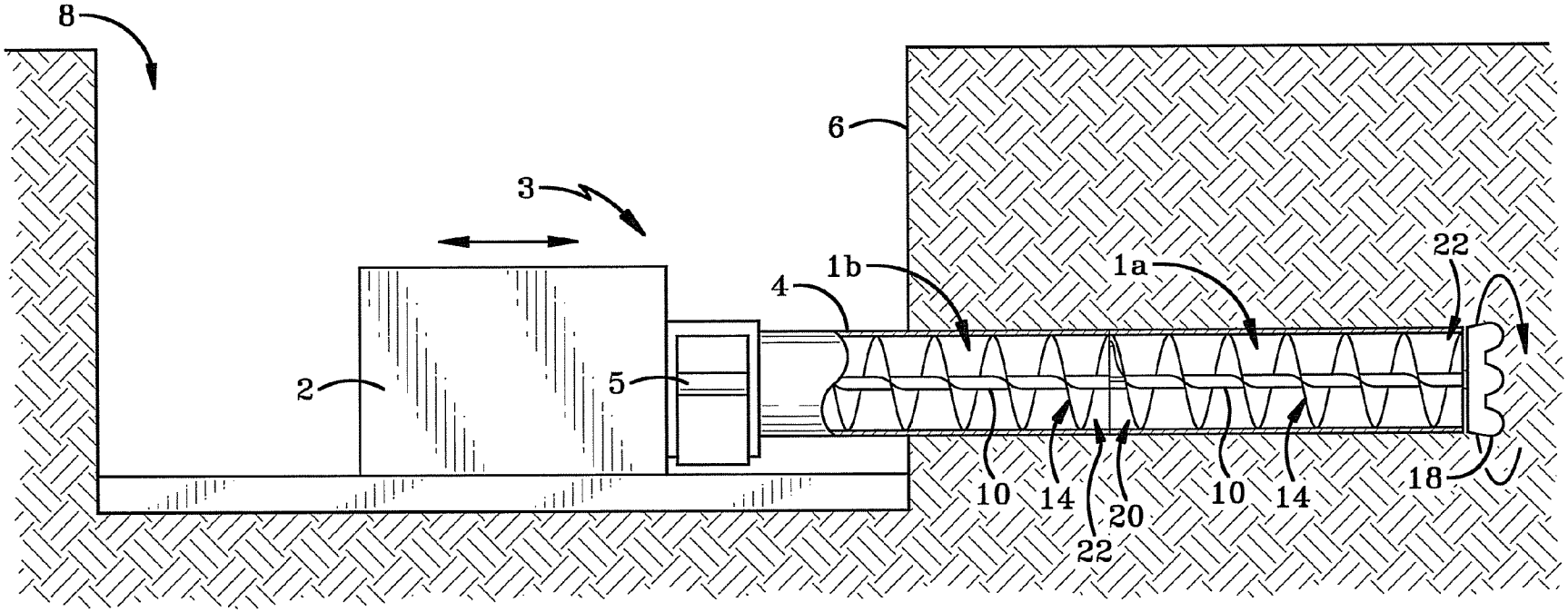
FIG. 1 is a side profile of a mechanically powered earth auger of the present invention with part of the drilling tube cut-away.
Figure 2:
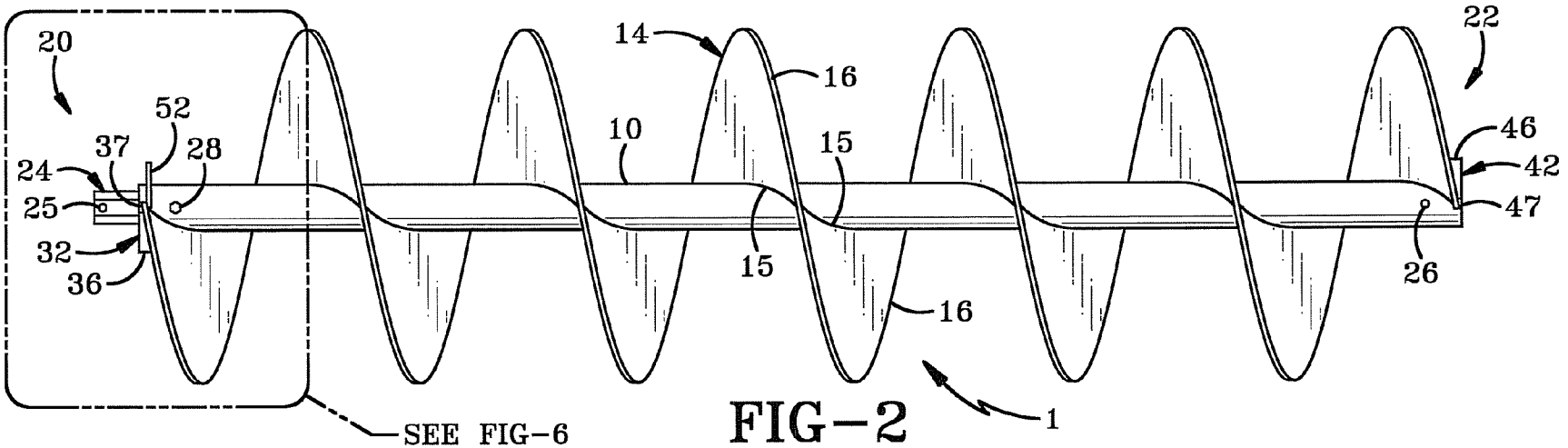
FIG. 2 is a side profile view of the reinforced earth auger length of the present invention.
Figure 3:
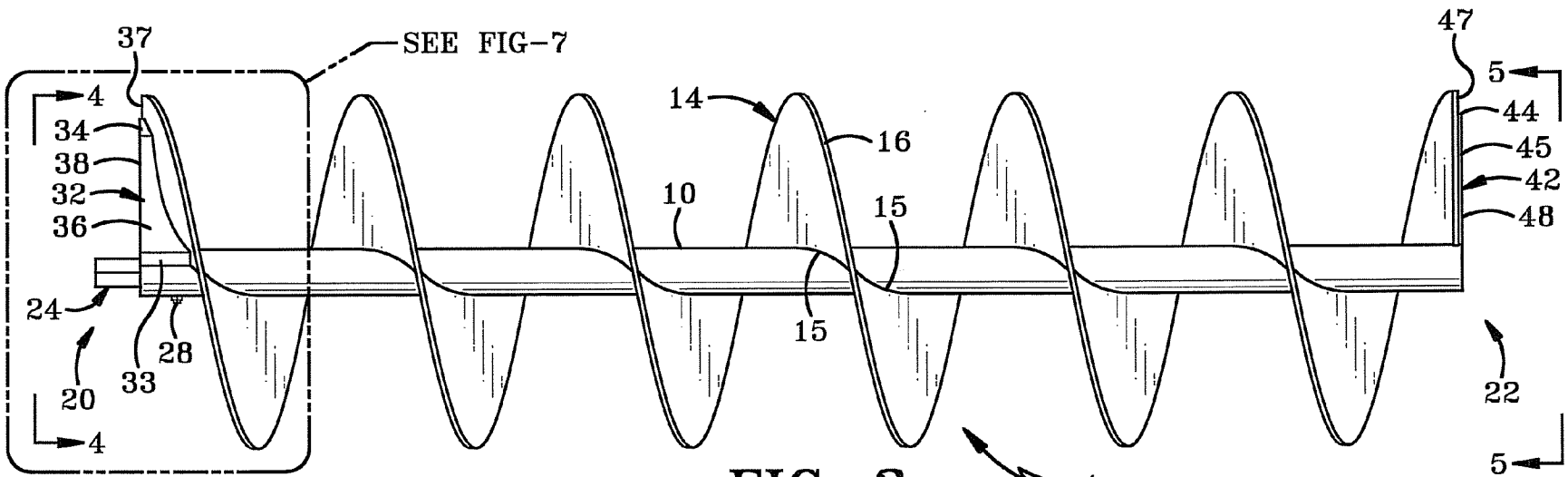
FIG. 3 is a side profile view the reinforced earth auger length of FIG. 2.

The reinforced earth auger length of the present invention is indicated generally at 1 in FIGS. 1 and 2 as an element of an earthen auger machine 3. Machine 3 is typically disposed in a pit 8 formed in the earth's soil or ground 6 and configured to bore a hole through ground 6 for the purpose of laying underground pipe in the bored hole. Machine 3 typically bores a hole from within a pit such as pit 8 to another pit which may be spaced several hundred feet away. Machine 3 includes an engine compartment 2 housing an engine (not shown) which powers the forward and axial momentum of a rotational output shaft 5 for rotationally driving the auger length 1. A tube 4 surrounds the plurality of auger lengths 1 stacked together longitudinally for extending into the hole formed in ground 6 and terminates with cutting head 18 attached at the end of the outermost auger length 1.

Reinforced auger length 1 of the present invention is comprised of a shaft 10, a flight 14, a back end 20, a front end 22, a back flight brace 32, a front flight brace 42, and a deflector 52. Back end 20 and front end 22 are located at opposite longitudinal ends of auger length 1 and spaced apart. Shaft 10 is generally cylindrical and runs the entire length of auger length 1 and transfers rotational torque to flight 14 from rotational output shaft 5. Flight 14 is helical and begins at edge 47 at front end 22 and spirally encircles shaft 10, terminating at edge 37 at back end 20. Flight 14 includes an inner edge 15 adjacent to shaft 10 along the length of shaft 10. Flight 14 also includes an outer edge 16, spaced apart and opposite from inner edge 15. Front flight brace 42 is proximate front end 22. Back flight brace 32 and deflector 52 are proximate back end 20.

Figure 7:
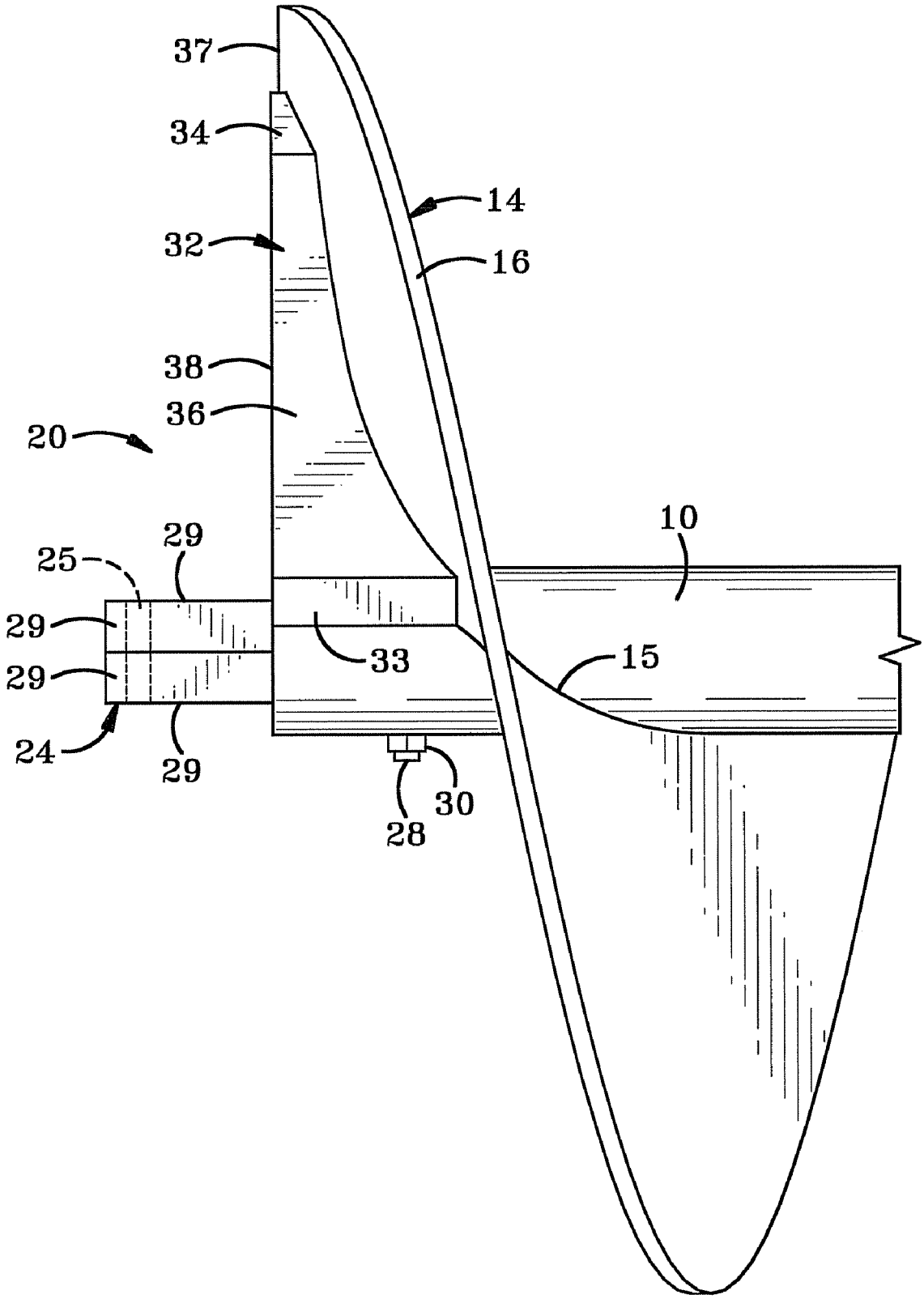
FIG. 7 is a side profile view of the back end of the reinforced auger length of FIG. 3, with portions cut away.

Back flight brace 32 is herein described in greater detail. Shown in FIG. 4, brace 32 is generally a box structure of steel or other strong metal, but may be a solid block of metal if desired. Brace 32 is proximate terminating edge 37 at back end 20 of auger length 1 and shaft 10. Back flight brace 32 includes a first end 33, a second end 34, an adjacent side 35, a distal side 36, and a top panel 38. First end 33 is proximate shaft 10, with a portion adjacent to shaft 10 and welded thereto. Shown in FIG. 7, first end 33 is generally flush with the outer end of shaft 10, extending along the length of shaft 10 and terminating at flight 14. Shown in FIG. 4 and 7, second end 34 is spaced apart from first end 33 and is generally proximate outer edge 16 of flight 14. Adjacent side 35 is adjacent to terminating edge 37 of flight 14, welded thereto in a generally straight weld parallel to terminating edge 37. Distal side 36 is spaced apart from side 35 and extends from first end 33 of back flight brace 32 to second end 34. One edge of side 36 is welded to flight 14 and complementary shaped to follow the helix of flight 14 from first end 33 to second end 34.

Outwardly extending ends 33 and 34, and outwardly extending sides 35 and 36 are welded together to form a box shape. The box bottom is formed from welding the box structure onto flight 14. The box top is formed from top panel 38 welded onto the extending and outer most edges of 33, 34, 35, and 36. In this way, a reinforcing box is formed on the rearmost flight blade to solidify flight 14 against rotational torque and compressive stress.

Front flight brace 42 is herein described in greater detail. Shown in FIG. 5 front flight brace 42 is substantially similar to back flight brace 32. Front flight brace 42 is generally a box structure of steel or other strong metal, but may be a solid block of metal if desired. Brace 42 is proximate edge 47 at front end 22 of auger length 1 and shaft 10, and includes a first end 43, a second end 44, an adjacent side 45, a distal side 46, and a top panel 48. Ends 43 and 44, and sides 45 and 46 are substantially similar to ends 33 and 34, and sides 35 and 36 and operate similarly on flight 14.

Substantially similar to back flight brace 32, front flight brace 42 is a box structure formed from welding together ends 43 and 44, and sides 45 and 46. The box bottom is formed from welding the box structure onto flight 14. The box top is formed from top panel 48 welded onto the extending and outer most edges of 43, 44, 45, and 46. In this way, a reinforcing box is formed on the rearmost flight blade to solidify flight 14 against rotational torque and compressive stress.

Figure 6:
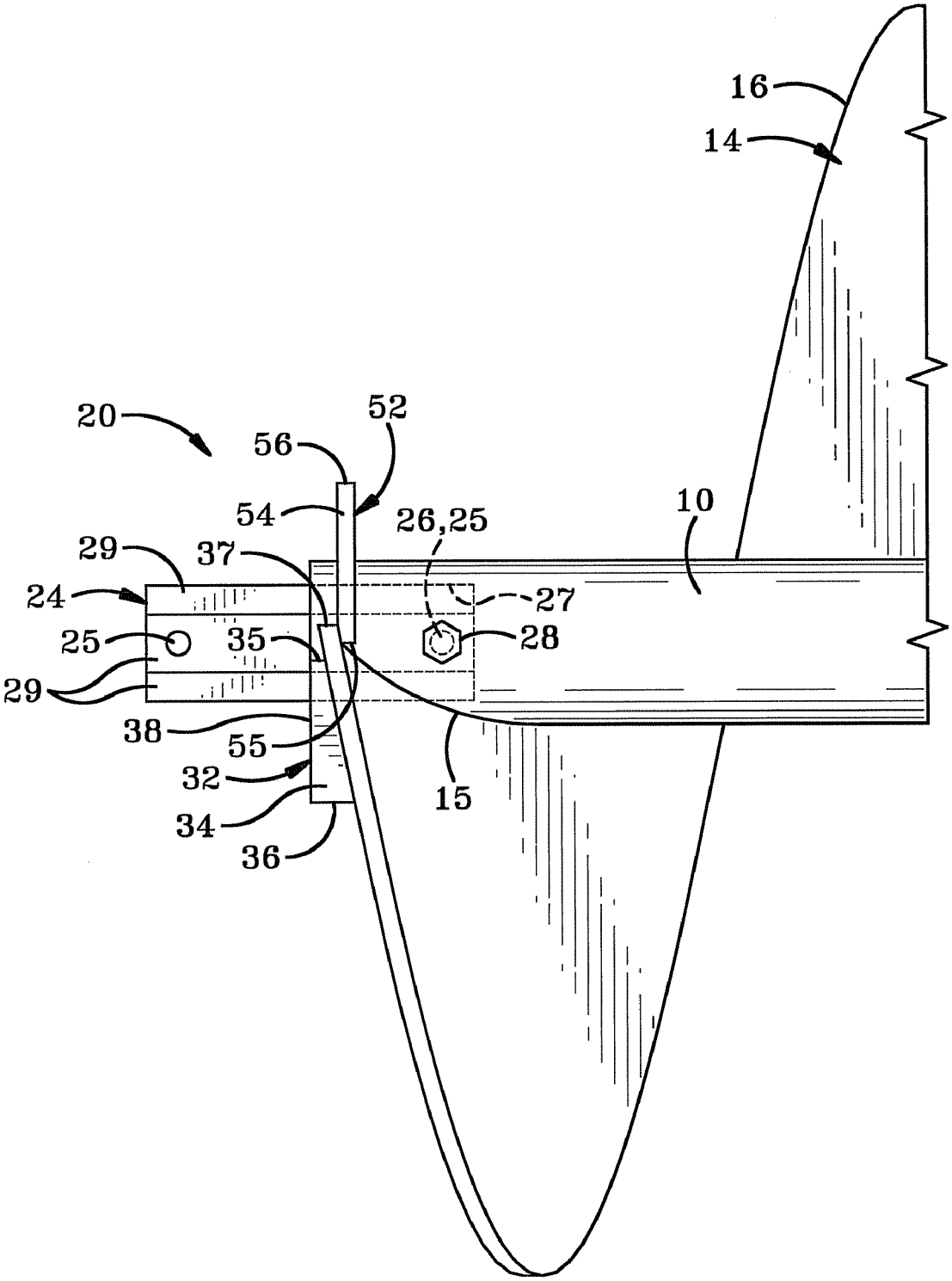
FIG. 6 is a side profile view of the back end of the reinforced auger length of FIG. 3, with portions cut away and part of the coupler shown in phantom.
Figure 8:
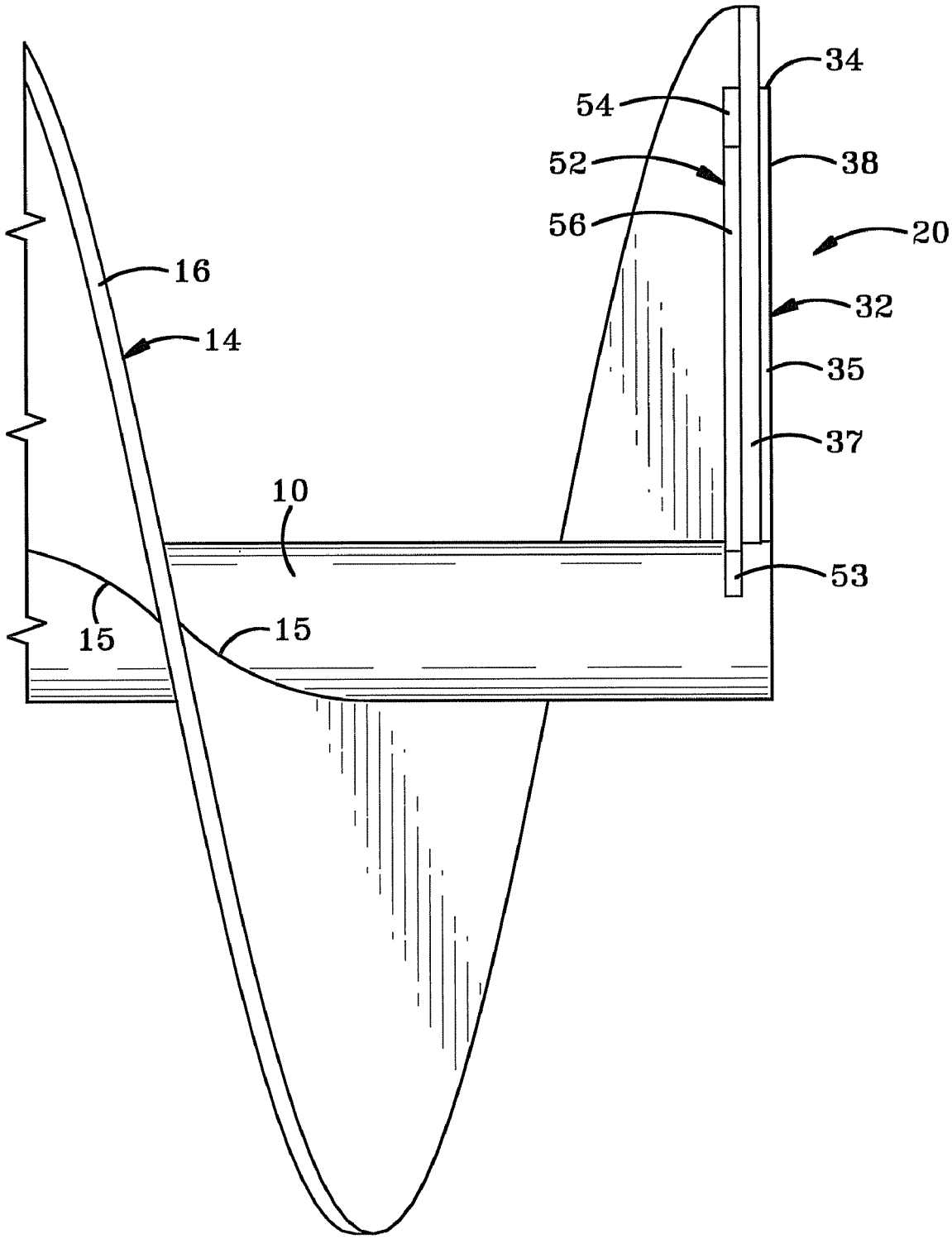
FIG. 8 is a side profile view of the back end of the reinforced auger big of FIG. 7, taken from the opposite side with parts cut away.

Deflector 52 is herein described in greater detail. Shown in FIG. 4, 6, and 8, deflector 52 is generally a solid and flat block of steel or other strong metal. Deflector 52 is proximate edge 37 at back end 20 of auger length 1 and shaft 10, and includes a first end 53, a second end 54, an adjacent side 55, and a distal side 56. Similarly to front flight brace 42 and back flight brace 32, first end 53 is proximate shaft 10, with a portion adjacent to shaft 10 and welded thereto. Second end 54 is spaced apart from first end 53 and is generally proximate outer edge 16 of flight 14. Adjacent side 55 is adjacent to terminating edge 37 of flight 14, welded thereto in a generally straight weld parallel to terminating edge 37. Shown in FIG. 4, adjacent side 55 is adjacent to terminating edge 37 on the opposite side from back flight brace 32. Distal side 56 is spaced apart from adjacent side 55 and distal to terminating edge 37.

Figure 4:
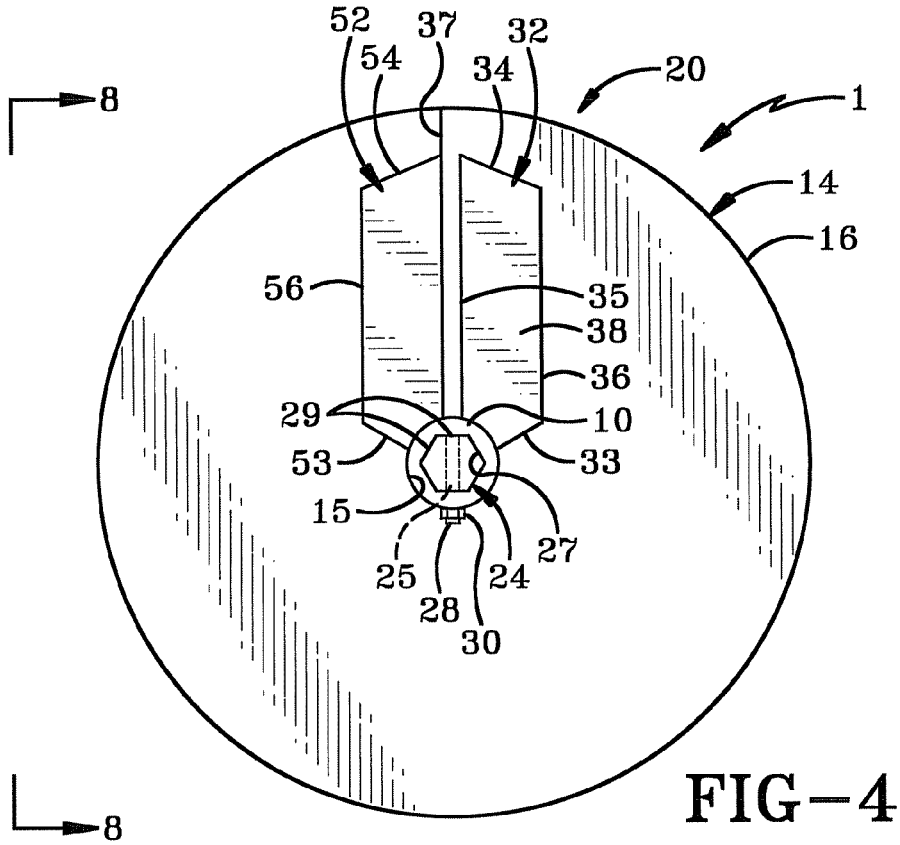
FIG. 4 is back profile view of the reinforced auger length of FIG. 3, taken along line 4-4 in FIG. 3.
Figure 5:
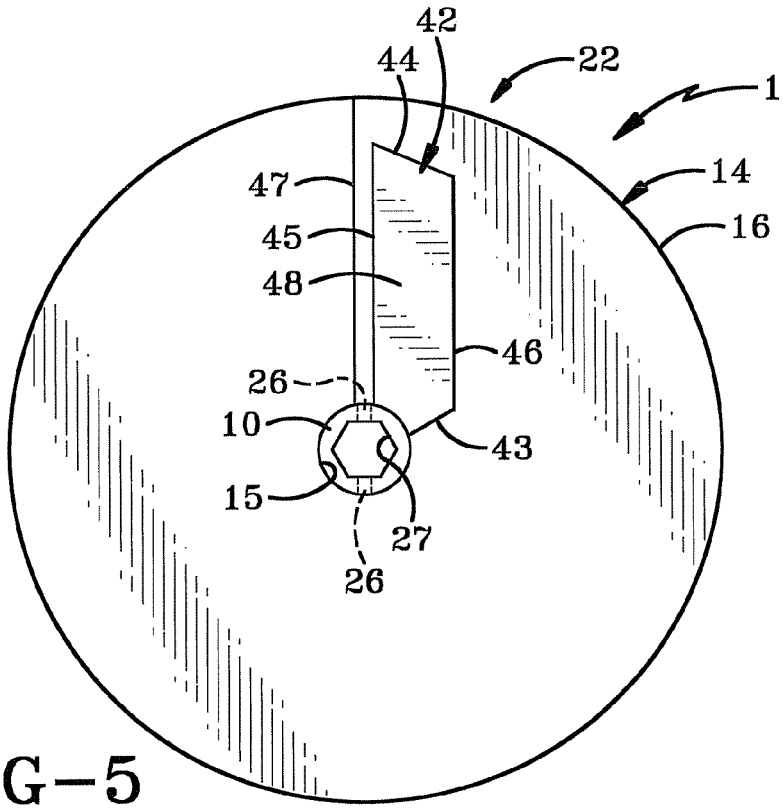
FIG. 5 is a front profile view of the reinforced auger length of FIG. 3, taken along line 5-5 in FIG. 3.

Auger lengths 1 of the present invention can be joined and securely held together by any general securing mechanism. The preferred method of securing two lengths 1 is shown in FIGS. 4 and 5. Shaft 10 of each length 1 includes a hexagonal joint hole 27 recessed longitudinally into shaft 10 at front 22 and back 20 end. Joint hole 27 receives approximately one half the length of a coupler 24. Coupler 24 includes two pin holes 25 and six flat sides 29 which are spaced to form a complementing hexagonal insert for joint hole 27. Pin holes 25 are spaced apart and parallel to one another, and extend from the center of side 29 of coupler 24 through and out the opposite and parallel side 29. Pin holes 25 are complementary aligned with a pin hole 26 in shaft 10, extending through joint hole 27 on each end 20 and 22 of auger length 1. Pin holes 25 and 26 receive a pin 28.

Figure 9:
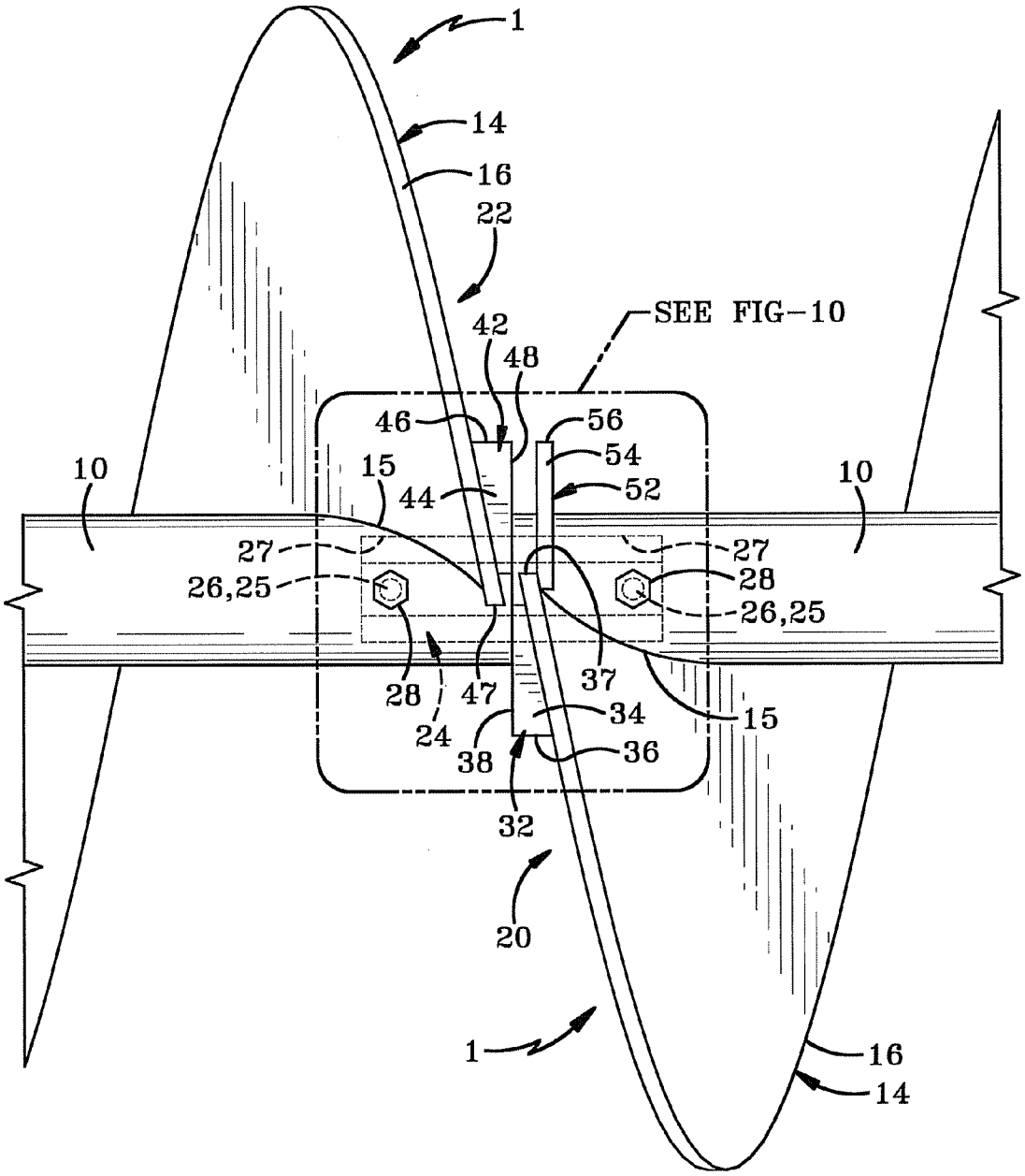
FIG. 9 is a side profile view of two auger length lengths coupled together, with the coupler shown in phantom, and parts cut away.
Figure 10:
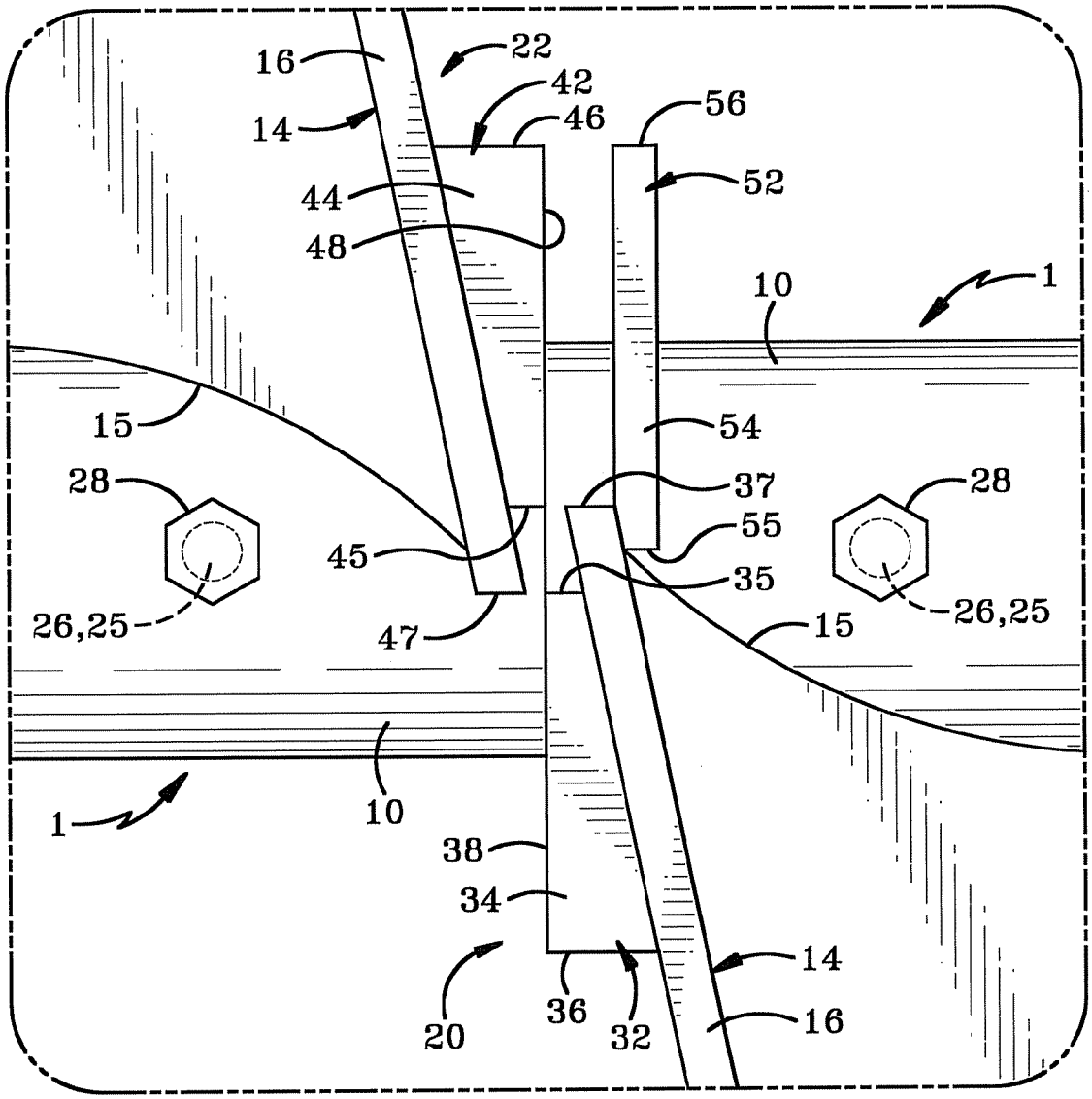
FIG. 10 is a profile view of the two auger coupling of FIG. 9.

Shown in FIG. 9 in phantom, as a means for securing two auger lengths 1, coupler 24 is inserted into joint hole 27. Joint hole 27 receives approximately one half the length of coupler 24, the protruding one half being inserted into second length 1. Pin 28 is inserted into pin hole 26 in shaft 10 and extended through pin hole 25 in coupler 24. The length of pin 28 allows it to pass entirely through coupler 24 and out pin holes 25 and 26 on the distal side of coupler 24 and shaft 10. Pin 28 is then secured with a nut 30, which tightly holds pin 28 and prevents its removal. Shown in FIG. 9 in phantom, each end of coupler 24 is inserted into a length 1 and secured through pin holes 25 and 26 to each length 1 by pins 28. Shown in FIG. 1, to facilitate drilling, cutting head 18 is attached to the first length 1 using coupler 24 in same manner as adding another length 1.

In the preferred method of operation, cutting head 18 is attached to front end 22 of length 1. Back end 20 of length 1 is attached to machine 3 at rotational output shaft 5. Machine 3 provides lateral movement as well as rotational movement to drive cutting head 18 into the soil. As rotational movement is transferred from output shaft 5 to shaft 10, flight 14 rotates axially around shaft 10, bringing soil outward from inside the bore hole due to the helical structure of flight 14.

As machine 3 moves length 1 and cutting head 18 farther into the soil, a maximum distance is eventually reached. If the desired bore hole depth has not yet been achieved, an additional length 1 is added. This is accomplished by manually disconnecting back end 20 of length 1*a* from output shaft 5, and connecting back end 20 of length 1*b* to output shaft 5. Back end 20 of length 1*a* is then connected to front end 22 of output shaft 1*b*, and the overall length of the structure is increased by the size of length 1*b*. Machine 3 is shown in FIG. 1 with auger lengths 1*a* and 1*b* coupled to extend the depth bore hole. The means for attaching lengths 1 is coupler 24, which is inserted into joint hole 27 in back end 20 of length 1*a*, as well as joint hole 27 in front end 22 of length 1*b*. Coupler 24 is secured by way of pins 28 extending through shaft 10 of each length 1*a* and 1*b*, and pin holes 25 and 26. Pins 28 are secured by nuts 30, which prevent pins 28 from being dislodged without removing nut 30.

As overall length of the structure is increased by adding more lengths 1, the linear structure of shaft 10 and stability of auger machine 3 is maintained by rear flight brace 32 and front flight brace 42. Braces 32 and 42 reinforce terminating edges 37 and 47 of flight 14, respectively, in each length 1. As flight 14 turns, terminating edges 37 and 47 are located at the transfer point where rotational power from one length 1 is transferred to the next length 1. This break in the overall longitudinal structure allows rotational torque to stress the trailing and leading terminating edges 37 and 47. Stress at edges 37 and 47 could lead to shearing or bending of flight 14, changing the helical shape and disrupting the flow of soil outward from the bore hole.

Deflector 52 is located at back end 20 of length 1 at terminating edge 37 of flight 14. As soil passes along flight 14, deflector 52 directs soil outward from terminating edge 37 and prevents soil from contacting front flight brace 42 of the subsequent length 1. This adds to the stability of length 1 by directing soil away from the leading edge 47 of length 1.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An auger length comprising:

a front and back end, said back end being opposite and spaced apart from the front end;

a helical auger flight beginning at the front end of the auger length and terminating at the back end, said flight having an inner and outer edge and a flight face defined therebetween, the outer edge being spaced apart from the inner edge and defining a radius of a hole to be drilled;

a central shaft proximate the inner edge of the flight and extending from the front end of the auger length to the back end; and a first flight brace proximate one of the front end and back end of the auger length, having a first and second end and integrally connected to the flight face, wherein the first flight brace further comprises a box shape, and wherein the box-shaped first flight brace includes an open bottom, and wherein the flight face closes the box.

2. The auger length of claim 1, wherein the first end of the first flight brace is proximate the shaft and inner edge of the auger flight, and the second end of the first flight brace is proximate the outer edge of the auger flight.

3. The auger length of claim 2, wherein the first flight brace further comprises an adjacent side, and wherein the adjacent side is complementary shaped to the flight face.

4. The auger length of claim 3, wherein the first flight brace further comprises a distal side, and wherein the distal side is generally flat and spaced apart from the adjacent side of the first flight brace.

5. The auger length of claim 4 wherein the box-shaped first flight brace is welded onto the flight.

6. The auger length of claim 1, further comprising a deflector, and wherein the deflector is substantially flat and elongated, and proximate the rear end of the auger length and having a first and second end.

7. The auger length of claim 6, wherein the first end of the deflector is proximate the shaft and inner edge of the auger flight, and the second end is proximate the outer edge of the auger flight.

8. The auger length of claim 7, wherein the deflector extends perpendicularly and outwardly from the shaft.

9. The auger length of claim 8, wherein the deflector extends outwardly from a terminating edge of the auger flight adjacent the back end of the auger length.

10. The auger length of claim 1, further comprising a second flight brace proximate the back end of the length having a first and second end, wherein the auger flight is a continuous auger flight.

11. The auger length of claim 9, further comprising a hole in the shaft proximate the front end of the auger length adapted to receive and hold a pin through the shaft.

12. The auger length of claim 9, further comprising a hole in the shaft proximate the rear end of the auger length adapted to receive and hold a pin through the shaft.

13. The auger length of claim 12, further comprising a front and rear joint hole extending into and parallel to the shaft from each end, and adapted to receive generally one half the length of a coupling mechanism.

14. The auger length of claim 1 wherein the box-shaped first flight brace is welded onto the flight.

* * * * *